US010206042B2

(12) United States Patent
Hviid et al.

(10) Patent No.: US 10,206,042 B2
(45) Date of Patent: Feb. 12, 2019

(54) 3D SOUND FIELD USING BILATERAL EARPIECES SYSTEM AND METHOD

(71) Applicant: BRAGI GmbH, München (DE)

(72) Inventors: Nikolaj Hviid, München (DE); Toby Martin, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/290,572

(22) Filed: Oct. 11, 2016

(65) Prior Publication Data

US 2017/0111740 A1 Apr. 20, 2017

Related U.S. Application Data

(60) Provisional application No. 62/244,154, filed on Oct. 20, 2015.

(51) Int. Cl.
*H04R 5/033* (2006.01)
*H04S 7/00* (2006.01)
*H04R 1/10* (2006.01)

(52) U.S. Cl.
CPC ..... *H04R 5/033* (2013.01); *H04S 7/303* (2013.01); *H04S 7/304* (2013.01); *H04R 1/1016* (2013.01);
(Continued)

(58) Field of Classification Search
CPC ..... H04R 5/033; H04R 1/1016; H04R 2225/025; H04R 2420/07; H04S 7/303; H04S 7/304
(Continued)

(56) References Cited

U.S. PATENT DOCUMENTS 3,934,100 A 1/1976 Harada
4,150,262 A 4/1979 Ono
(Continued)

FOREIGN PATENT DOCUMENTS

EP 1017252 A2 7/2000
EP 2690407 A1 1/2014
(Continued)

OTHER PUBLICATIONS

International Search Report & Written Opinion, PCT/EP16/75120 (dated Feb. 9, 2017).
(Continued)

*Primary Examiner* — William A Jerez Lora
(74) *Attorney, Agent, or Firm* — Goodhue, Coleman & Owens, P.C.

(57) ABSTRACT

A set of wireless earpieces includes a left wireless earpiece comprising an earpiece housing sized and shaped to fit into an external auditory canal of a user, a speaker disposed within the earpiece and positioned to transduce audio towards a tympanic membrane associated with the external auditory canal of the user, a right wireless earpiece comprising an earpiece housing sized and shaped to fit into an external auditory canal of a user, a speaker disposed within the earpiece and positioned to transduce audio towards a tympanic membrane associated with the external auditory canal of the user, and wherein the left earpiece and the right earpiece are adapted to process sound in order to alter perception of the sound to match a pre-determined point of view for the user.

17 Claims, 7 Drawing Sheets

(52) U.S. Cl.
CPC .... *H04R 2225/025* (2013.01); *H04R 2420/07* (2013.01); *H04R 2430/01* (2013.01)

(58) Field of Classification Search
USPC ..... 381/56, 58, 310, 311, 312, 313
See application file for complete search history.

(56) References Cited

U.S. PATENT DOCUMENTS

| | | | |
|---|---|---|---|
| 4,334,315 | A | 6/1982 | Ono et al. |
| 4,375,016 | A | 2/1983 | Harada |
| 4,588,867 | A | 5/1986 | Konomi |
| 4,654,883 | A | 3/1987 | Iwata |
| 4,682,180 | A | 7/1987 | Gans |
| 4,791,673 | A | 12/1988 | Schreiber |
| 4,865,044 | A | 9/1989 | Wallace et al. |
| 5,191,602 | A | 3/1993 | Regen et al. |
| 5,201,007 | A | 4/1993 | Ward et al. |
| 5,280,524 | A | 1/1994 | Norris |
| 5,295,193 | A | 3/1994 | Ono |
| 5,298,692 | A | 3/1994 | Ikeda et al. |
| 5,343,532 | A | 8/1994 | Shugart |
| 5,363,444 | A | 11/1994 | Norris |
| 5,497,339 | A | 3/1996 | Bernard |
| 5,606,621 | A | 2/1997 | Reiter et al. |
| 5,613,222 | A | 3/1997 | Guenther |
| 5,692,059 | A | 11/1997 | Kruger |
| 5,721,783 | A | 2/1998 | Anderson |
| 5,749,072 | A | 5/1998 | Mazurkiewicz et al. |
| 5,771,438 | A | 6/1998 | Palermo et al. |
| 5,802,167 | A | 9/1998 | Hong |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,208,372 | B1 | 3/2001 | Barraclough |
| 6,275,789 | B1 | 8/2001 | Moser et al. |
| 6,339,754 | B1 | 1/2002 | Flanagan et al. |
| 6,408,081 | B1 | 6/2002 | Boesen |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,654,721 | B2 | 11/2003 | Handelman |
| 6,664,713 | B2 | 12/2003 | Boesen |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| 7,463,902 | B2 | 12/2008 | Boesen |
| 7,508,411 | B2 | 3/2009 | Boesen |
| 7,983,628 | B2 | 7/2011 | Boesen |
| 8,140,357 | B1 | 3/2012 | Boesen |
| 8,718,930 | B2 * | 5/2014 | Tachibana ..... G01C 21/00 701/428 |
| 9,693,137 | B1 * | 6/2017 | Qureshi ..... H04R 3/005 |
| 2001/0005197 | A1 | 6/2001 | Mishra et al. |
| 2001/0027121 | A1 | 10/2001 | Boesen |
| 2001/0056350 | A1 | 12/2001 | Calderone et al. |
| 2002/0002413 | A1 | 1/2002 | Tokue |
| 2002/0007510 | A1 | 1/2002 | Mann |
| 2002/0010590 | A1 | 1/2002 | Lee |
| 2002/0030637 | A1 | 3/2002 | Mann |
| 2002/0046035 | A1 | 4/2002 | Kitahara et al. |
| 2002/0057810 | A1 | 5/2002 | Boesen |
| 2002/0076073 | A1 | 6/2002 | Taenzer et al. |
| 2002/0118852 | A1 | 8/2002 | Boesen |
| 2003/0065504 | A1 | 4/2003 | Kraemer et al. |
| 2003/0100331 | A1 | 5/2003 | Dress et al. |
| 2003/0104806 | A1 | 6/2003 | Ruef et al. |
| 2003/0115068 | A1 * | 6/2003 | Boesen ..... G10L 15/005 704/277 |
| 2003/0125096 | A1 | 7/2003 | Boesen |
| 2003/0218064 | A1 | 11/2003 | Conner et al. |
| 2004/0070564 | A1 | 4/2004 | Dawson et al. |
| 2004/0160511 | A1 | 8/2004 | Boesen |
| 2005/0043056 | A1 | 2/2005 | Boesen |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2006/0147068 | A1 * | 7/2006 | Aarts ..... A61B 5/02438 381/309 |
| 2008/0254780 | A1 | 10/2008 | Kuhl et al. |
| 2009/0010456 | A1 * | 1/2009 | Goldstein ..... H04R 25/02 381/110 |
| 2010/0074460 | A1 | 3/2010 | Marzetta |
| 2010/0290636 | A1 | 11/2010 | Mao et al. |
| 2011/0299707 | A1 * | 12/2011 | Meyer ..... H04S 7/304 381/310 |
| 2013/0083173 | A1 * | 4/2013 | Geisner ..... G06F 3/013 348/51 |
| 2014/0058662 | A1 * | 2/2014 | Tachibana ..... G01C 21/00 701/428 |
| 2015/0110285 | A1 | 4/2015 | Censo et al. |
| 2016/0324478 | A1 * | 11/2016 | Goldstein ..... A61B 5/721 |

FOREIGN PATENT DOCUMENTS

| | | | |
|---|---|---|---|
| EP | 2819437 | A1 | 12/2014 |
| GB | 2074817 | | 4/1981 |
| JP | 06292195 | | 10/1998 |
| WO | 2014043179 | A2 | 3/2014 |
| WO | 2015110577 | A1 | 7/2015 |
| WO | 2015110587 | A1 | 7/2015 |

OTHER PUBLICATIONS

Announcing the $3,333,333 Stretch Goal (Feb. 24, 2014).
BRAGI is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).

(56) References Cited

OTHER PUBLICATIONS

BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI—Prototypes (Jun. 26, 2014).
BRAGI Update—Office Tour, Tour to China, Tour to CES (Dec. 11, 2014).
BRAGI Update—Status on Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, On Track(May 16, 2015).
BRAGI Update—Beta2 Production and Factory Line(Aug. 20, 2015).
BRAGI Update—Certifications, Production, Ramping Up (Nov. 13, 2015).
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2014).
BRAGI Update—On Track, Design Verification, How It Works and What's Next(Jul. 15, 2015).
BRAGI Update—On Track, On Track and Gems Overview (Jun. 24, 2015).
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).
Last Push Before the Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).

* cited by examiner

3D SOUND FIELD USING BILATERAL EARPIECES SYSTEM AND METHOD

PRIORITY STATEMENT

This application claims priority to U.S. Provisional Patent Application 62/244,154, filed on Oct. 20, 2015, and entitled 3D Sound Field Using Bilateral Earpieces System and Method, hereby incorporated by reference in its entirety.

FIELD OF THE INVENTION

The present invention relates to wearable devices. More particularly, but not exclusively, the present invention relates to ear pieces.

BACKGROUND

The use of earpieces at the external auditory canal affords the user with the ability to perceive sound presented to them at a relatively close proximity to the tympanic membrane. Currently sound is delivered to each middle ear without detailed discrimination of greater details concerning the right or left sides of their environments. As such, a great deal of the audio experience is lost through the lack of availability of such audio data. What is needed is a new system and method for the transmission of greater details so that a three dimensional sound field is presented to the user. This would serve to heighten the user experience through the variable expression of sound in a three dimensional space.

SUMMARY

Therefore, it is a primary object, feature, or advantage of the present invention to improve over the state of the art.

It is a further object, feature, or advantage of the present invention to experience sound in a three dimensional sphere from different points of view.

It is a still further object, feature, or advantage of the present invention to enhance the user experience within a sound sphere.

Another object, feature, or advantage is to increase user comfort through the ability to tune the user's own sound environment to fit what is most comfortable for them.

Yet another object, feature, or advantage is to allow the user to experience the sound field from varying points of view.

A further object, feature, or advantage is to detect the position of the user in the three dimensional sound sphere that could be achieved through data emerging from the onboard accelerometers.

A still further object, feature, or advantage is to position the user in a three dimensional sound space to feed information to the user as to relative position, relative speed, etc. on a time based model.

One or more of these author other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an objects, features, or advantages stated herein.

According to one aspect, a set of wireless earpieces includes a left wireless earpiece comprising an earpiece housing sized and shaped to fit into an external auditory canal of a user, a speaker disposed within the earpiece and positioned to transduce audio towards a tympanic membrane associated with the external auditory canal of the user and a right wireless earpiece comprising an earpiece housing sized and shaped to fit into an external auditory canal of a user, a speaker disposed within the earpiece and positioned to transduce audio towards a tympanic membrane associated with the external auditory canal of the user. The left earpiece and the right earpiece are adapted to process sound in order to alter perception of the sound to match a pre-determined point of view for the user. At least one of the left wireless earpiece and the right wireless earpiece may further include a sensor to provide sensed data and wherein the sensed data is used to provide the pre-determined point of view for the user. The sensor may be an inertial sensor such as an accelerometer or a physiological sensor such as a pulse oximeter. Sound may be processed in various ways such as by inserting delays, altering amplitude or volume of sound signals, and/or adding reverberation and other effects. Sound may be altered such that it is perceived as emanating from a particular direction relative to the user such as behind the user, in front of the user, the left side of the user, to the right side of the user, above the user, or below the user, or moving relative to the user.

According to another aspect a method is provided. The method includes providing a left earpiece and a right earpiece, selecting a point of view for a user within a sound field, processing the sound field based on the point of view for the user to produce a left sound signal for the left earpiece and a right sound signal for the right earpiece, and reproducing the left sound signal at the left earpiece and the right sound signal at the right earpiece. The step of selecting the point of view for the user within the sound field may be based in part on sensor data collected from one or more sensors in the left earpiece or the right earpiece. The one or more sensors may include an inertial sensor such as an accelerometer or a physiological sensor such as a pulse oximeter. The processing may be performed on a computing device separate from the left earpiece and the right earpiece such as a mobile device such as a mobile phone.

DETAILED DESCRIPTION

Figure 1:
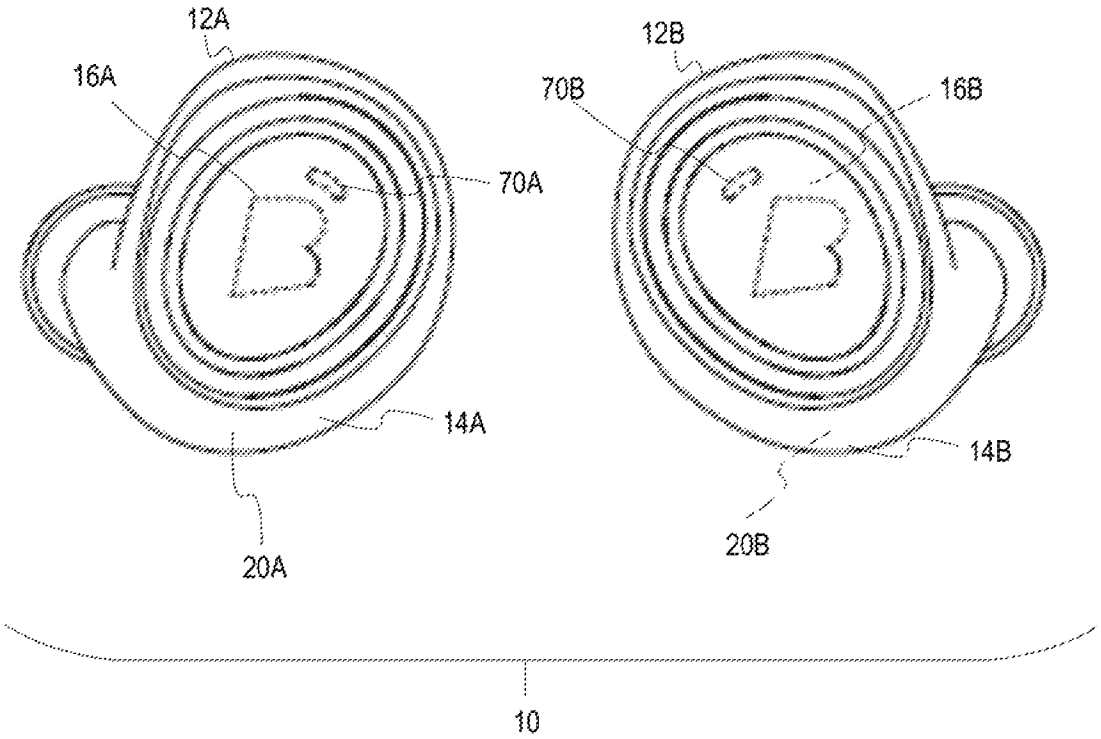
FIG. 1 illustrates a pair of wireless earpieces.

FIG. 1 illustrates one example of a wearable device in the form of a set of earpieces 10 including a left ear piece 12A and a right earpiece 12B. Each of the ear pieces 12A, 12B has a housing 14A, 14B which may be in the form of a protective shell or casing and may be an in-the-ear earpiece housing. A left infrared through ultraviolet spectrometer 16A and right infrared through ultraviolet spectrometer 16B is also shown. Air microphones 70A, 70B are also shown.

Note that the air microphones 70A, 70B are outward facing such that the air microphones 70A, 70B may capture ambient environmental sound. It is to be understood that an number of microphones may be present.

Figure 2:
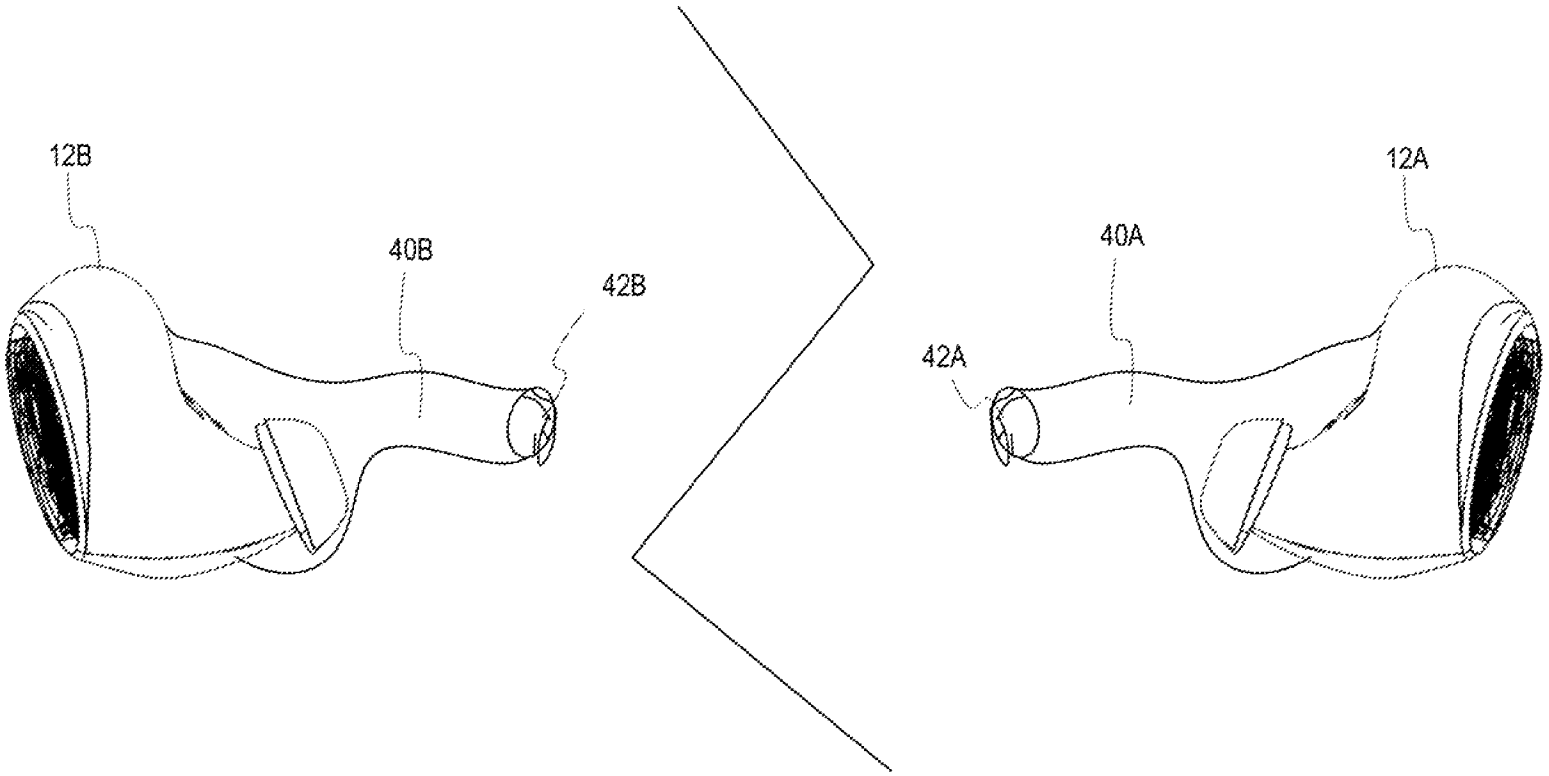
FIG. 2 illustrates a pair of wireless earpieces positioned within the external auditory canals of a user.

FIG. 2 illustrates ear pieces 12A, 12B placed on and inserted into an ear of an individual or user. The ear pieces 12A, 12B each fit at least partially into the external auditory canal 40A, 40B of the individual. A tympanic membrane 42A, 42B is shown at the end of the external auditory canal 40A, 40B. Note that given the placement of each earpiece 12A, 12B at least partially within the external auditory canal, one or more speakers of each earpiece 12A, 12B is in very close proximity to the tympanic membrane 42A, 42B. Given the nature of ear canal earpieces, the ability to spatially localize the sound origin within a three dimensional environment is heightened. This allows the user to experience the programming from different points of view, or alternatively, to focus on a particular position within the three dimensional sound sphere. Through the use of appropriate algorithms, the user is able to select a position within the sound sphere for increased immersive effect. Alternatively, instead of selecting the position within the sound sphere, the programming may drive this selection.

Figure 3:
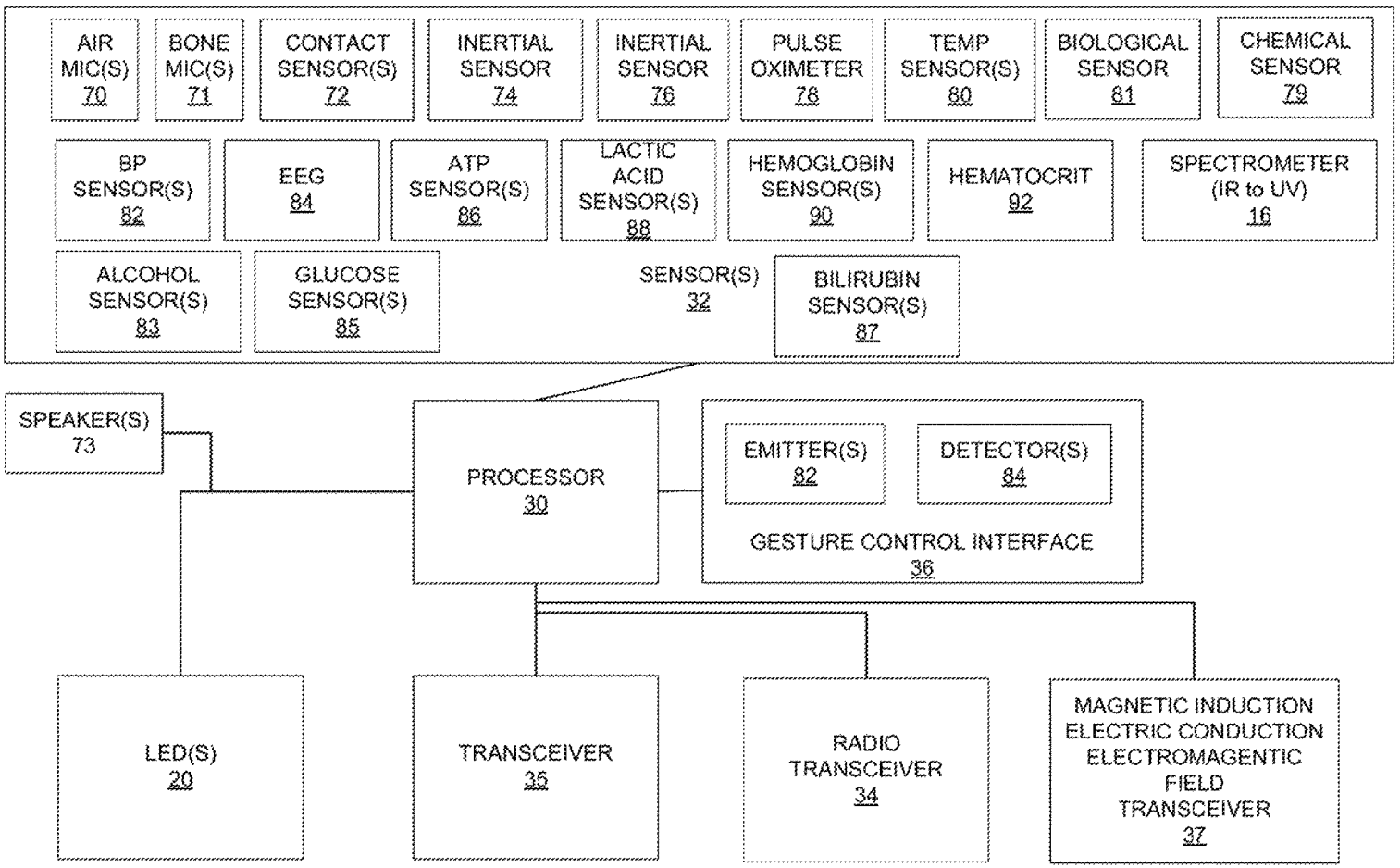
FIG. 3 is a block diagram illustrating on example of an earpiece.

FIG. 3 is a block diagram illustrating a device. The device may include one or more LEDs 20 electrically connected to a processor 30 or other intelligent control system. The processor 30 may also be electrically connected to one or more sensors 32. Where the device is an earpiece, the sensor(s) may include an inertial sensor 74, another inertial sensor 76. Each inertial sensor 74, 76 may include an accelerometer, a gyro sensor or gyrometer, a magnetometer or other type of inertial sensor. The sensor(s) 32 may also include one or more contact sensors 72, one or more bone conduction microphones 71, one or more air conduction microphones 70, one or more chemical sensors 79, a pulse oximeter 76, a temperature sensor 80, or other physiological or biological sensor(s). Further examples of physiological or biological sensors include an alcohol sensor 83, glucose sensor 85, or bilirubin sensor 87. Other examples of physiological or biological sensors may also be included in the device. These may include a blood pressure sensor 82, an electroencephalogram (EEG) 84, an Adenosine Triphosphate (ATP) sensor, a lactic acid sensor 88, a hemoglobin sensor 90, a hematocrit sensor 92 or other biological or chemical sensor.

A spectrometer 16 is also shown. The spectrometer 16 may be an infrared (IR) through ultraviolet (UV) spectrometer although it is contemplated that any number of wavelengths in the infrared, visible, or ultraviolet spectrums may be detected. The spectrometer 16 is preferably adapted to measure environmental wavelengths for analysis and recommendations and thus preferably is located on or at the external facing side of the device.

A gesture control interface 36 is also operatively connected to the processor 30. The gesture control interface 36 may include one or more emitters 82 and one or more detectors 84 for sensing user gestures. The emitters may be of any number of types including infrared LEDs. The device may include a transceiver 35 which may allow for induction transmissions such as through near field magnetic induction. A short range transceiver 34 using Bluetooth, BLE, UWB, or other means of radio communication may also be present. In operation, the processor 30 may be configured to convey different information using one or more of the LED(s) 20 based on context or mode of operation of the device. The various sensors 32, the processor 30, and other electronic components may be located on the printed circuit beard of the device. One or more speakers 73 may also be operatively connected to the processor 30. A magnetic induction electric conduction electromagnetic (E/M) field transceiver 37 or other type of electromagnetic field receiver or magnetic induction transceiver is also operatively connected to the processor 30 to link the processor 30 to the electromagnetic field of the user. The use of the E/M transceiver 37 allows the device to link electromagnetically into a personal area network or body area network or other device.

Although the earpiece shown includes numerous different types of sensors and features, it is to be understood that each earpiece need only include a basic subset of this functionality. It is further contemplated that sensed data may be used in various ways depending upon the type of data being sensed and the particular application(s) of the earpieces.

Figure 4:
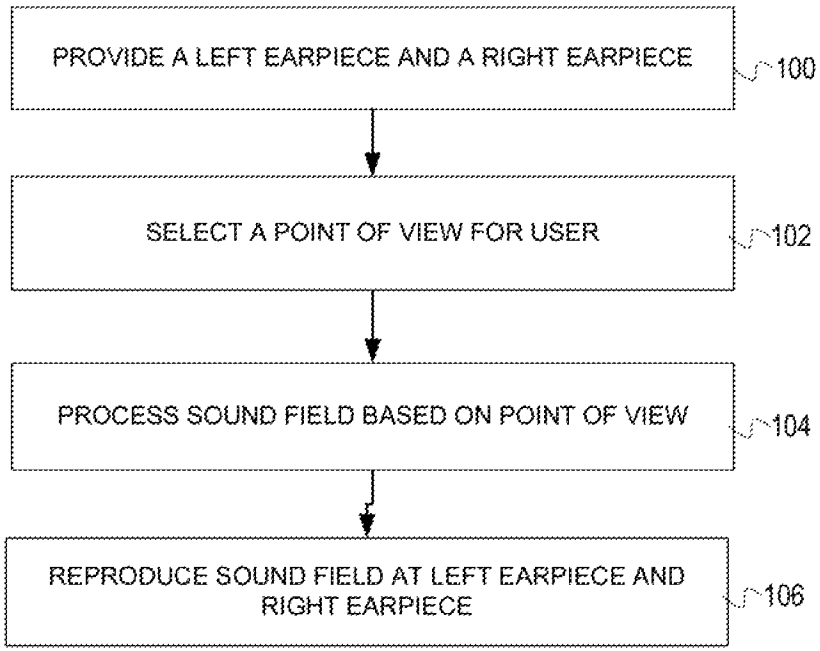
FIG. 4 illustrates one example of a methodology for creating enhanced sound experience for a user of earpieces.

FIG. 4 illustrates one example of a methodology which may be performed using the left and right earpieces. In step 100, the left and right earpieces are provided. In step 102, a point of view for the user is selected. The user may select the point of view in any number of ways including through a voice interface, a user interface of one or more of the earpieces or a user interface of a mobile device or other computing device in operative communication with one or more of the earpieces. Alternatively, the point of view may be selected in whole or in part programmatically such as by taking into consideration inertial sensor data or other sensor data, user preferences, or other information. Next, in step 104, the sound field is processed based on the selected point of view. The sound field may include one sound source or many sound sources. In step 106, the sound field is reproduced at the left earpiece and the right earpiece of the user.

Figure 5:
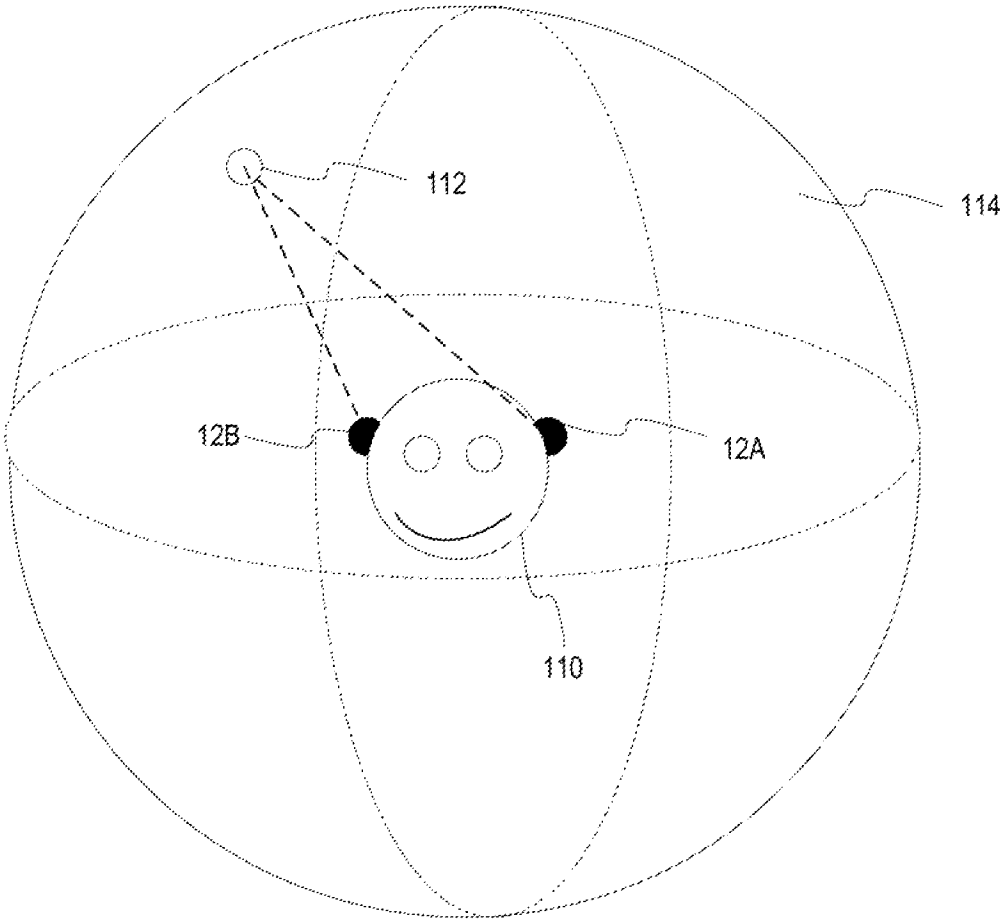
FIG. 5 illustrates a sound sphere for a user.

FIG. 5 illustrates the concept of the sound sphere 114 in greater detail. As shown in FIG. 15 a user 110 is present wearing a left earpiece 12A and a right earpiece 12B. The user 110 is shown within a three-dimensional sound sphere 114. Also within the sound sphere 114 is a sound source 112. Although only a single sound source 112 is shown, it is contemplated that any number of different sound sources 112 may be present at any number of different locations within the sphere 114. Note that as shown in FIG. 5 there will be differences in the representation of the sound source 112 which is reproduced at the right ear piece 12B and the representation of the sound source 112 which is reproduced at the left earpiece 12A to reflect the difference in positions between the respective earpieces 12A, 12B and the sound source 112. For instance, one earpiece may be nearer the sound source 112 than the other earpiece and thus would hear the sound source slightly sooner and slightly louder, the sound may reverberate slightly different and other differences in the sound may be expressed. In addition, although there are no obstacles between the sound source 112 and the earpieces 12A, 12B, other than the head of the user with respect to earpiece 12A, in other examples there may be obstacles present which would serve to led to further differences between sounds from the sound source 112 reproduced at earpiece 12B and sounds from the sound source 112 reproduced at earpiece 12A.

The position within the sound sphere may be oriented using the head movement of the user. The head movement may be determined using one or more inertial sensors. Thus, for example, sound may be produced which takes into account head movement or position.

One manner in which sound localization may be affected is through modifying the perception of direction. Where two earpieces are used, there may be left/right, high/low, front/back qualities associated with sound where a sound is first perceived in one ear and then the other. Another method for altering this perception is through the relative volumes of sound, thus a sound coming from one direction would be perceived as slightly louder in the earpiece nearest the perceived sound source. Another method relates to modifying reverberation time in order to alter perception of how near or how far away a sound's source is. Thus, perception of sound can be modified in various ways including through adding delays in a sound signal or adjusting the amplitude of a sound signal, or otherwise. It is to be understood that sound signals may be altered or modified so that sound is perceived as coming from a particular direction or moving along a particular path.

In addition to sound localization in these examples, other examples may take into account the position of one or more speakers of each earpiece relative to the tympanic membrane of a user in order to shape sounds which provide the desired effect. Thus altering sound qualities allows for perception of pitch, loudness, phase, direction, distance, and timbre to be altered. In addition, the sound processing may take into account movement of the user through monitoring head position of the user by using one or more accelerometers or other inertial sensors in each earpiece.

Running Program

Figure 6:
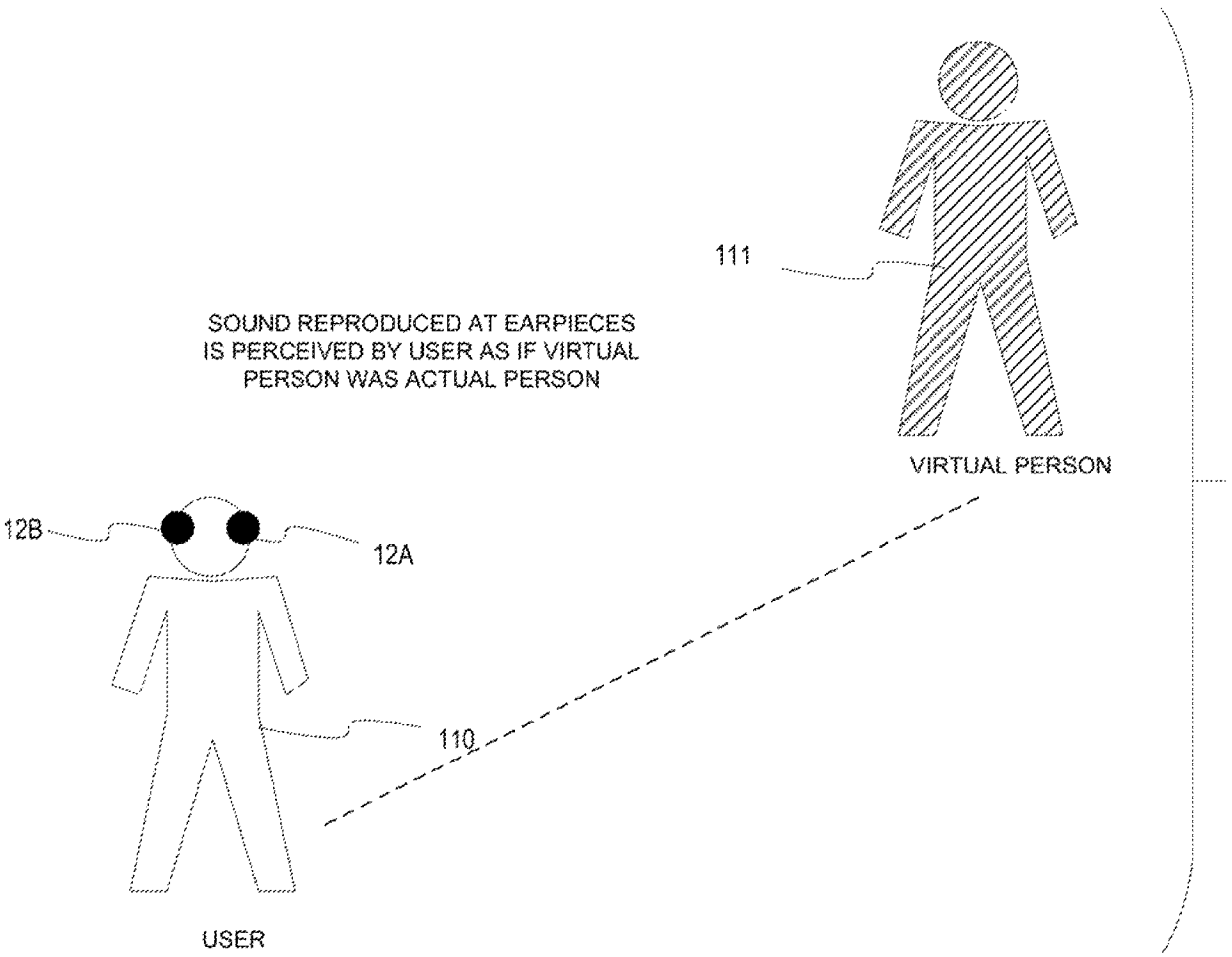
FIG. 6 illustrates an example of an application where user experience is enhanced by creating sound perceived as footsteps of another person.

In this example one's progress is tracked while running or jogging. The user's progress may be gauged by where the user is in relation to preselected variables. One example of the preselected variables may be a desired pace or a previous run time. In this example, when the user is faster than the desired pace, a typical pace, or previously set pace, the user could perceive the sound of footsteps behind them with the volume of the sounds directly proportional to the distance or time that one is ahead of schedule. Thus, if the user decreases their pace the footsteps grow louder and if the user increases their pace the footsteps grow softer. FIG. 6 illustrates a user wearing earpieces 12A, 12B and a virtual person 111 behind the person 110. Here, the sound reproduced at the earpieces 12A, 12B is such that it is perceived by the user as if the virtual person is an actual person jogging with the user and maintaining a desired pace.

It is further contemplated that the desired pace need not be a fixed pace but may be variable. For example, where one or more of the earpieces includes a pulse oximeter, the desired pace may be associated with a pace necessary to maintain the pulse rate at a given rate and thus when the user has a pulse rate that is lower than the desired pulse rate the footsteps may grow louder to encourage the user to move faster so as to increase their pulse rate.

Orientation for Mapping or Location Services

Figure 7:
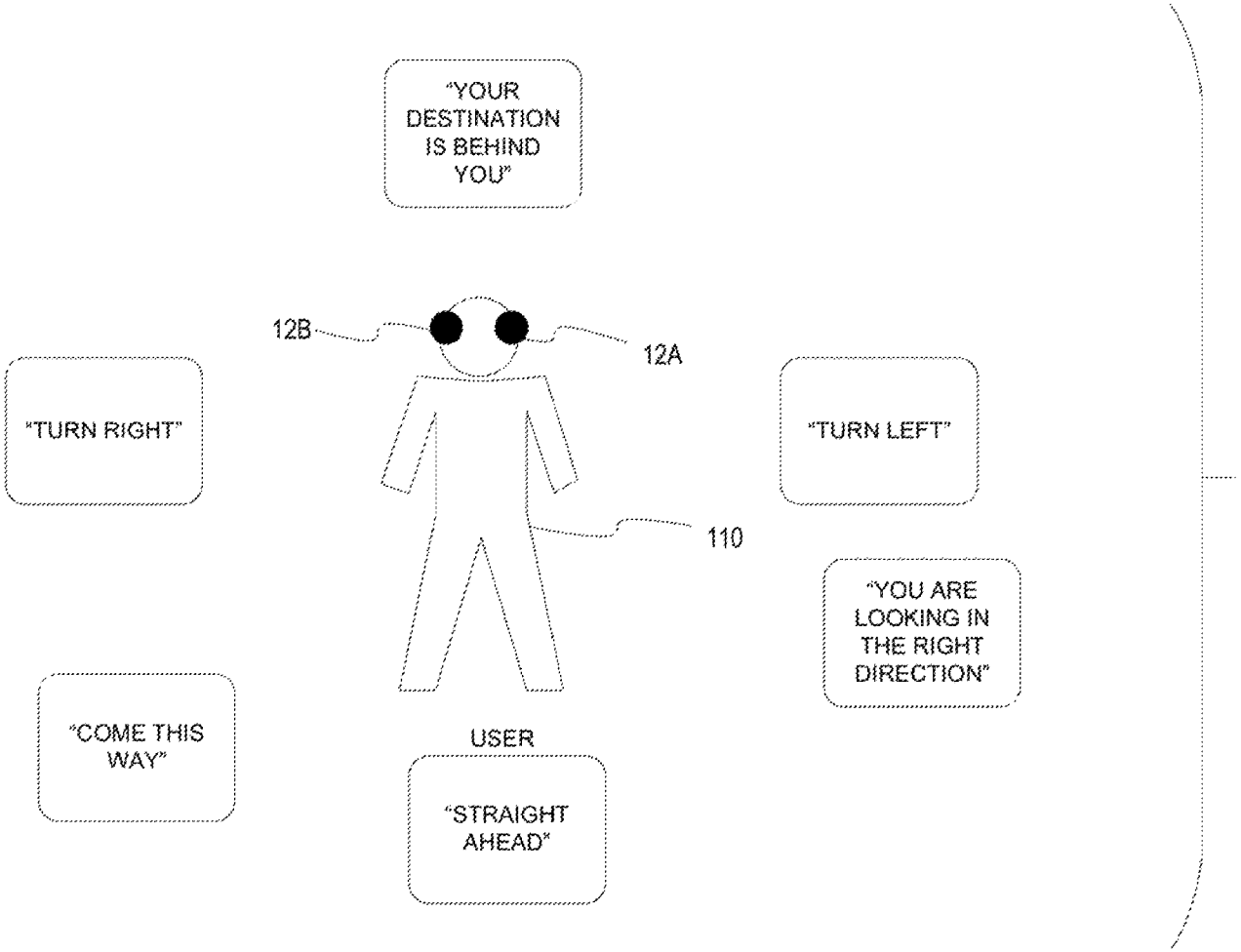
FIG. 7 illustrates an example where user experience is enhanced by receiving instructions which are perceived as coming from particular directions.

In this example, the device is being used to provide directions to a user. For example, the user is in motion. Instead of merely giving conventional directions, e.g. turn left or right, go straight, the user could perceive sound as coming from the direction in which the user is to go. The sound may be directions such as "This way" or "Follow me" or other sound or may be the conventional direction such as "Turn Left", "Turn Right", "Go back, the destination is behind you", "You are headed in the right direction", "You are facing the right direction." This may be particularly useful in situations where there are not clearly defined paths, for example while the user is swimming in a lake or ocean, when the user is attempting to find someone else within a crowd, or analogous situations. Note that the directions provided may take into account not just the location of the user relative to a destination or route, but also accelerometer data showing head position or movement or other information. FIG. 7 illustrates a user 110 wearing earpieces 12A, 12B which are configured to provide directions which are perceived as emanating from a location which provides additional context.

Orientation for Identifying Dangers

In this example, the device is being used to convey not merely the presence of a danger but to convey relative location of the danger. In this example, a warning message which may contain voice message or other sound is perceived as coming from the direction of where the actual danger is. Thus, a person may process this information more quickly and identify the danger more quickly. Although various examples of the use of spatially localized sound origins are provided, it is contemplated that numerous other examples are possible.

Change of Point of View for Performance

In this example, audio may be delivered to the left and right earpieces in order for the user to experience a concert, an athletic event, or other type of performance. In this example, a user may select the point of view from which the would like to experience the performance. For example, the audio may be associated with a particular venue such as a concert hall or a sports venue. The user may select as their point of view where in the venue they are seated. This selection process may occur in various ways such as through voice input into the earpieces or otherwise using a user interface of the earpieces. Alternatively, input may be received through a mobile device or other computing device in operative communication with the earpieces such as through Bluetooth and/or BLE or other wireless communications. Thus, for example, a user could select where they wish to sit through selection from a map of the venue or by providing a section, row, and seat number. It is also contemplated that in a performance the complexity of processing will be increased with the number of sound sources. Thus, for example, for a performance of a solo pianist a single sound source could be used (although if desired multiple sound sources associated with the piano could be used) and for an orchestra multiple sound sources could be used simultaneously which increases the complexity of processing.

Therefore, various examples of systems, devices, apparatus, and methods for 3D sound field manipulation using earpieces have been shown and described. Although various embodiments and examples have been set forth, the present invention contemplates numerous variations, options, and alternatives.

What is claimed is:

1. A set of wireless earpieces comprising:

a left wireless earpiece comprising an earpiece housing sized and shaped to fit into an external auditory canal of a user, a processor disposed of within the earpiece housing, a speaker disposed within the earpiece housing operatively connected to the processor and positioned to transduce audio towards a tympanic membrane associated with the external auditory canal of the user, at least one microphone operatively connected to the processor, an inertial sensor operatively connected to the processor, and a gesture control interface operatively connected to the processor;

a right wireless earpiece comprising an earpiece housing sized and shaped to fit into an external auditory canal of a user, a processor disposed of within the earpiece housing, a speaker disposed within the earpiece housing operatively connected to the processor and positioned to transduce audio towards a tympanic membrane associated with the external auditory canal of the user, at least one microphone operatively connected to the processor, an inertial sensor operatively connected to the processor, and a gesture control interface operatively connected to the processor;

wherein the left earpiece and the right earpiece are adapted to process sound through an algorithm in order to alter perception of a plurality of sound sources within a sound field for the user, wherein the plurality of sound sources are based upon user-selected point of view within the sound field from which the user would like to experience the plurality of sound sources for increased immersive effect, wherein the user-selected point of view moves in response to movement of the user;

wherein the left earpiece and the right earpiece are adapted to associate a current position of the user with the user-selected point of view within the sound field.

2. The set of wireless earpieces of claim 1 wherein the inertial sensor of the left wireless earpiece and the inertial sensor of the right wireless earpiece provide sensed data and wherein the sensed data is used to provide a pre-determined point of view for the user.

3. The set of wireless earpieces of claim 1 wherein the inertial sensor is an accelerometer.

4. The set of wireless earpieces of claim 1 wherein the left wireless earpiece further comprises physiological sensor and wherein the right wireless earpiece further comprises a physiological sensor and the physiological sensor of the left wireless earpiece and the physiological sensor of the right wireless earpiece provide sensed data and wherein the sensed data used to provide a pre-determined point of view of the user.

5. The set of wireless earpieces of claim 4 wherein the physiological sensor is a pulse oximeter.

6. The set of wireless earpieces of claim 1 wherein the left earpiece and the right earpiece are adapted to process sound by inserting delays in sound signals.

7. The set of wireless earpieces of claim 1 wherein the left earpiece and the right earpiece are adapted to process sound by altering amplitudes of sound signals.

8. The set of wireless earpieces of claim 1 wherein the sound is altered such that it is perceived as emanating from behind the user.

9. A method comprising:

providing a left earpiece and a right earpiece each of the left and right earpiece housing a processor, at least one speaker operatively connected to the processor, at least one microphone operatively connected to the processor, an inertial sensor operatively connected to the processor, and a gestural control interface operatively connected to the processor;

establishing a point of view at a concert, an athletic event or other type of performance within a sound field;

altering the point of view within the sound field from which the user would like to experience a plurality of sound sources for increased immersive effect; wherein altering the point of view for the user within the sound field is based in part on sensor data gathered from the one or more sensors in the left earpiece or the right earpiece, wherein the sensor data is indicative of a change in head position and head orientation;

associating a current position of the user with the altered point of view within the sound field;

processing through an algorithm the sound source within the sound field based on the altered point of view for the user to produce a left sound signal for the left earpiece and a right sound signal for the right earpiece using at least a processor of at least one of the left earpiece and the right earpiece; and reproducing the left sound signal at the left earpiece and the right sound signal at the right earpiece, wherein the left sound signal and the right sound signal provide the user with the plurality of sound sources perceived as if the user were located at the altered point of view.

10. The method of claim 9 wherein the at least one inertial sensor is an accelerometer.

11. The method of claim 9 wherein the left earpiece and the right earpiece further house at least one physiological sensor.

12. The method of claim 11 wherein the at least one physiological sensor comprises a pulse oximeter.

13. The method of claim 9 wherein the altering is performed on a computing device separate from the left earpiece and the right earpiece.

14. The method of claim 13 wherein the computing device is a mobile device.

15. The method of claim 14 wherein the mobile device is a mobile phone.

16. A method comprising:

providing a left earpiece and a right earpiece each of the left and right earpiece housing a processor, at least one speaker operatively connected to the processor, at least one microphone operatively connected to the processor, an inertial sensor operatively connected to the processor, and a gestural control interface operatively connected to the processor;

establishing a point of view for a user within a sound sphere;

altering the point of view for the user within the sound sphere from which the user would like to experience a plurality of sound sources for increased immersive effect;

processing through algorithms the plurality of sound sources within the sound sphere based on the selected point of view for the user to produce a left sound signal for the left earpiece and a right sound signal for the right earpiece using at least a processor of at least one of the left earpiece and the right earpiece;

sensing user gestures via the gesture control interface of at least one of the left earpiece and the right earpiece, wherein the gesture control interface of the at least one of the left earpiece and the right earpiece may include at least one emitter and at least one detector;

reproducing the left sound signal at the left earpiece and the right sound signal at the right earpiece; and altering the perception of sound so it is perceived as coming from the plurality of sound sources based upon the selected point of view, wherein the plurality of sound sources can be perceived as moving within the sound sphere independent of the user's movement.

17. The method of claim 16, further comprising the step of using data collected from the inertial sensor of the left earpiece and the inertial sensor of the right earpiece, wherein the sensed data is used to provide the point of view for the user.

* * * * *